United States Patent [19]

Leotta et al.

[11] 4,375,874

[45] Mar. 8, 1983

[54] ROLLED TISSUE DISPENSER

[75] Inventors: Samuel S. Leotta, Conshohocken; James G. Petro, Harleysville, both of Pa.; Arthur A. Ortner, Westville, N.J.

[73] Assignee: Bradley Corporation, Menomonee Falls, Wis.

[21] Appl. No.: 240,908

[22] Filed: Mar. 5, 1981

[51] Int. Cl.[3] ..... B65H 19/04

[52] U.S. Cl. ..... 242/55.3; 242/55.53

[58] Field of Search ..... 242/55.3, 55.53; 225/47, 46; 312/38-40

[56] References Cited

U.S. PATENT DOCUMENTS

| | | | |
|---|---|---|---|
| 3,211,504 | 10/1965 | Bump | 312/39 |
| 3,294,329 | 12/1966 | Tucker et al. | 242/55.3 |
| 3,381,909 | 5/1968 | Tucker et al. | 242/55.3 |
| 3,475,068 | 10/1969 | Mott, Sr. et al. | 312/39 |
| 3,620,466 | 11/1971 | Bump | 242/55.3 |
| 3,637,276 | 1/1972 | Bump | 312/39 |
| 3,650,487 | 3/1972 | Bahnsen | 242/55.3 |
| 3,677,485 | 7/1972 | Berg | 242/55.3 |

*Primary Examiner*—Leonard D. Christian

*Attorney, Agent, or Firm*—Quarles & Brady

[57] ABSTRACT

A two roll tissue dispenser includes a housing having a pair of compartments each having a spindle for a roll of the tissue. The housing has a front piece with an opening which is half closed by a sliding door. In its initial position, the door closes off only the upper compartment and the roll of tissue in the lower compartment is exposed for dispensing. When the roll of tissue in the lower compartment is exhausted, the door can be moved down to expose the second roll in the upper compartment for dispensing. The tissue dispenser includes a door control mechanism which prevents the door from being moved to expose the second roll until the first roll is exhausted and also prevents the door once it has been moved to expose the reserve roll from being returned to its original position without first opening the housing.

4 Claims, 8 Drawing Figures

ROLLED TISSUE DISPENSER

The present invention relates to a rolled tissue dispenser. More particularly, it relates to a dispenser which holds two rolls of tissue and presents only one roll at a time for dispensing.

BACKGROUND OF THE INVENTION

It is desirable, especially in public restrooms, to have rolled tissue dispensers which are capable of holding at least two rolls of tissue. The use of such dispensers provides considerable labor savings as they do not have to be refilled as often as dispensers that hold a single roll.

In the past, a number of two-roll dispensers have been proposed and patented. However, none of them are without disadvantage. Some are overly large, and others are inconvenient to load or use.

BRIEF SUMMARY OF THE PRESENT INVENTION

It is an object of the present invention to provide a two-roll dispenser which is compact, convenient to load and use and which requires that the first roll of tissue be exhausted before the second roll is exposed for dispensing.

The two-roll dispenser of the present invention includes a hollow housing having a pair of compartments each having a horizontal spindle for holding a roll of tissue. Each of the spindles is mounted on its own arm which can be moved outwardly for loading convenience. The housing has an opening in the front in which is mounted a sliding half door which closes one of the compartments so that only one roll of tissue is exposed at any time. When the dispenser is loaded, the roll of tissue in one compartment is in a dispensing position and the roll of tissue in the other compartment is in a reserve position behind the door which closes off that compartment. A door control mechanism prevents the door from being moved to expose the reserve roll before the first roll is exhausted and also prevents the door once it has been moved to expose the reserve roll from being returned to its original position without first opening the housing.

The forementioned and other advantages and objects of the invention will be apparent from the specification and the description which follows:

DESCRIPTION OF THE PREFERRED EMBODIMENT

Figure 1:
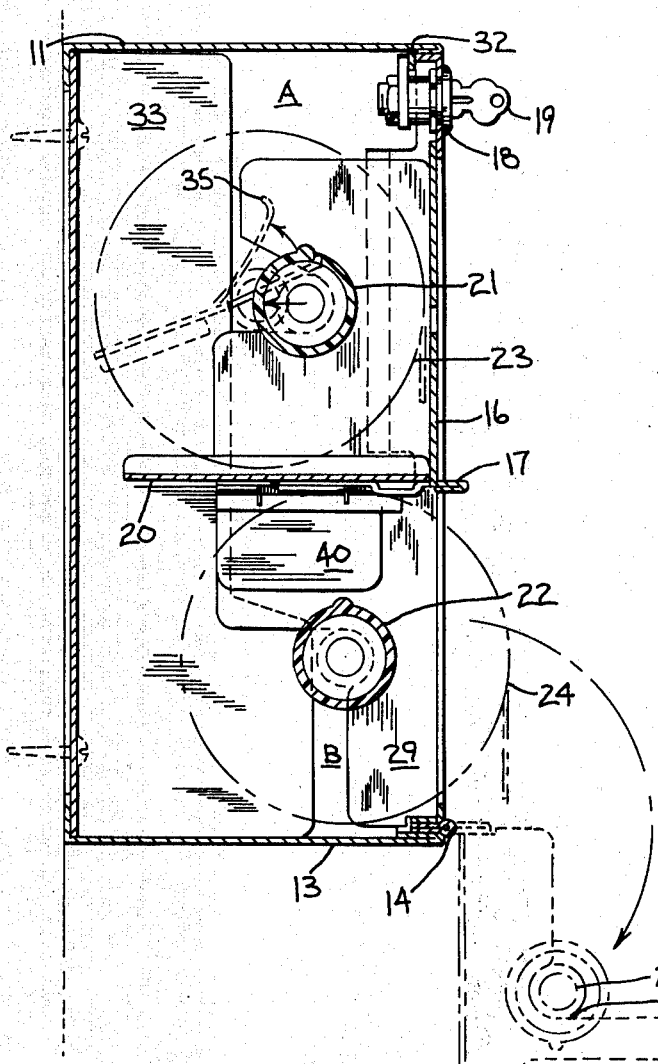
FIG. 1 is a perspective view of the preferred dispenser of the present invention.
Figure 1:
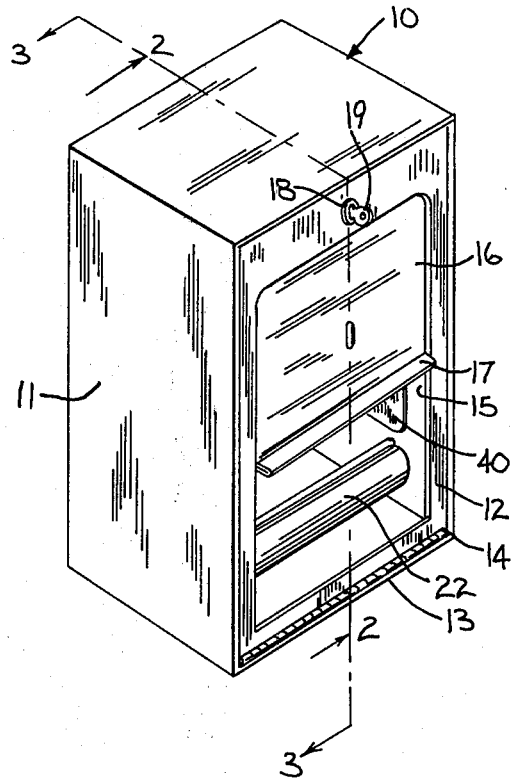

Referring to the drawings and especially to FIG. 1, it can be seen that the dispenser 10 includes a hollow rectangular housing 11 having a front piece 12 which is attached to the bottom 13 of the housing 11 by a hinge 14. The front piece 12 has an opening 15 which is partially closed by a slidable half door 16 having a handle 17. The front piece 12 is secured in place closing the housing 11 by a combination lock and latch 18 having a key 19.

Figure 2:
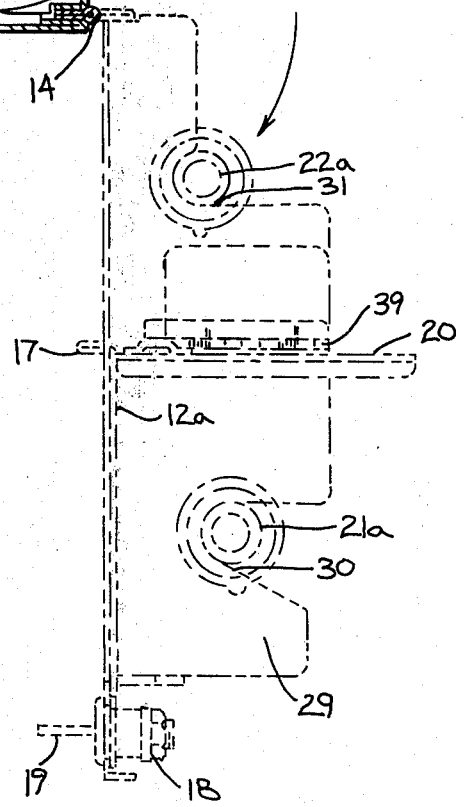
FIG. 2 is an enlarged sectional view taken along lines 2—2 of FIG. 1 showing the dispenser both closed and open for loading.
Figure 3:
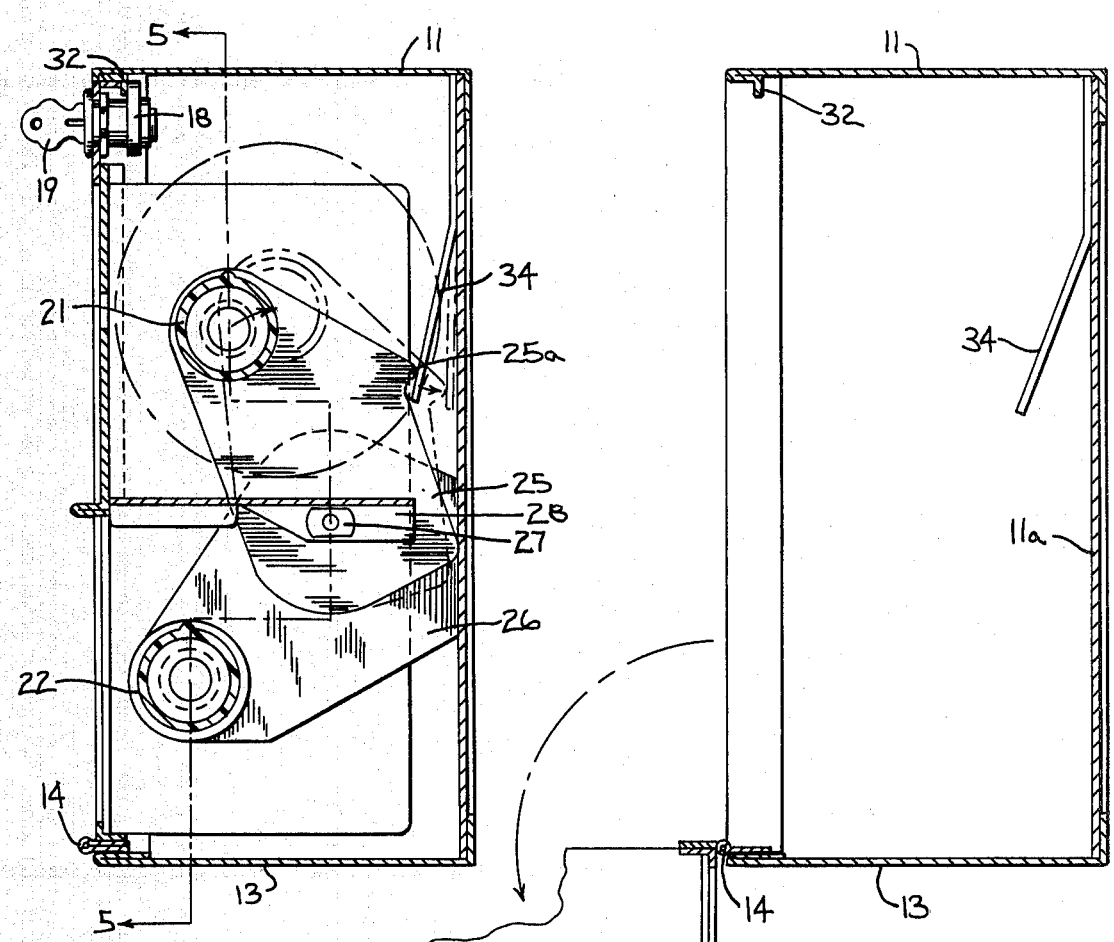
FIG. 3 is an enlarged sectional view taken along lines 3—3 of FIG. 1.

Turning to FIG. 2 and FIG. 3, it can be seen that the interior of the closed housing 11 is divided into two separate compartments A and B by a shelf 20 attached to the inside 12*a* of the front piece 12. The upper compartment A and the lower compartment B each has a horizontal spindle 21 and 22, respectively, for holding tissue rolls 23 and 24, respectively (shown in broken lines in FIG. 2). As seen best in FIG. 2, the upper compartment A is closed by the door 16 and the lower compartment B is open so that roll 24 is available for dispensing.

Figure 4:
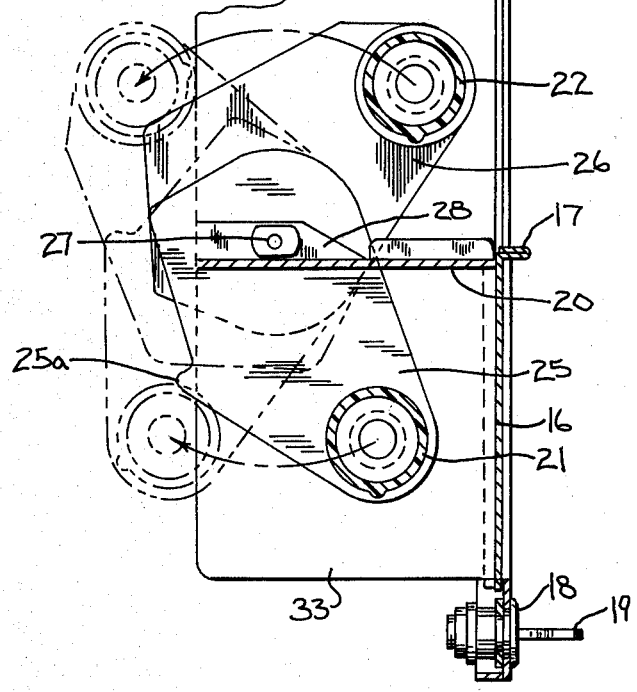
FIG. 4 is a view similar to FIG. 3 with the dispenser open for loading.
Figure 5:
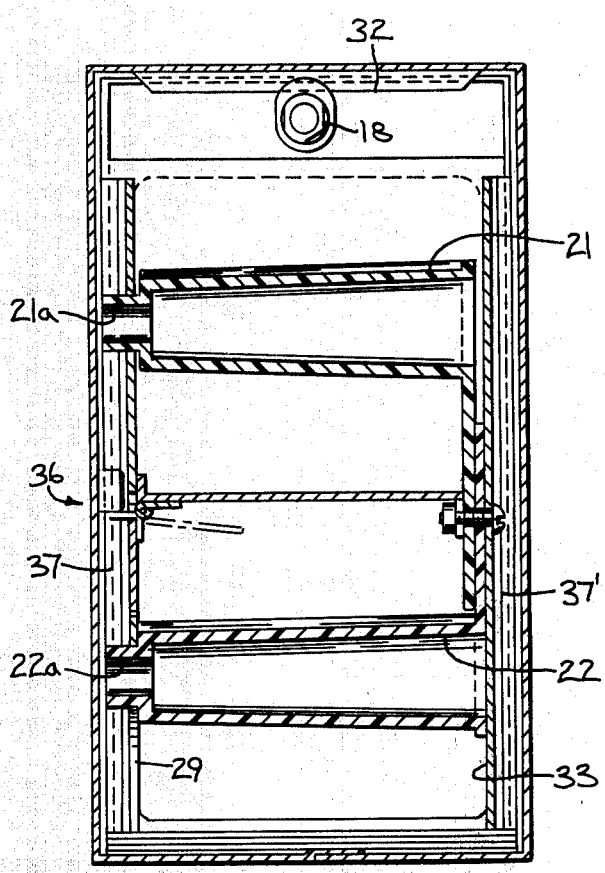
FIG. 5 is a sectional view taken along lines 5—5 of FIG. 3.
Figure 7:
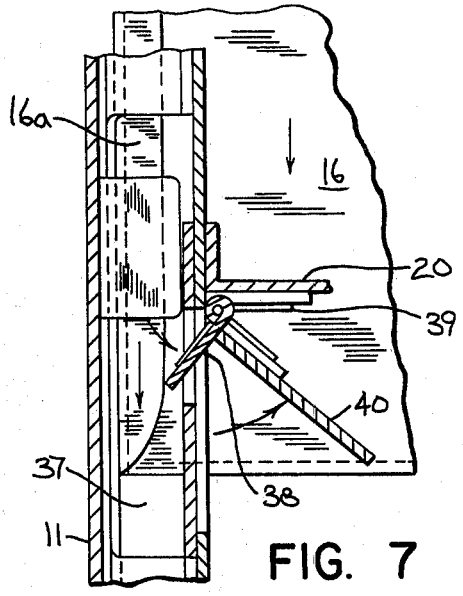
FIGS. 6, 7 and 8 are enlarged views showing the door control mechanism seen in FIG. 5 at various stages of operation.
Figure 6:
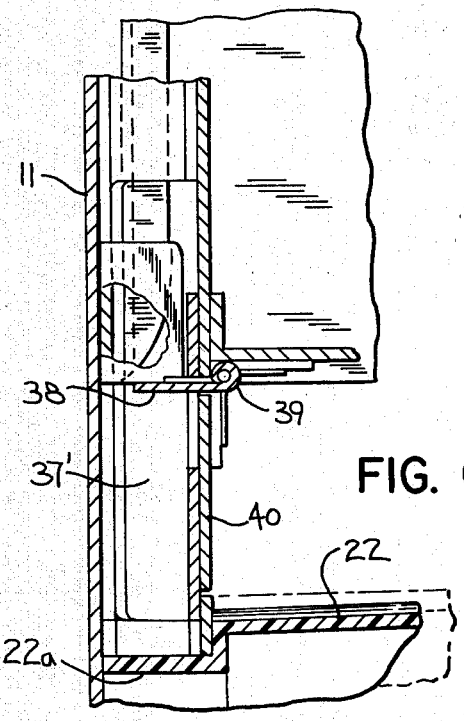
Figure 8:
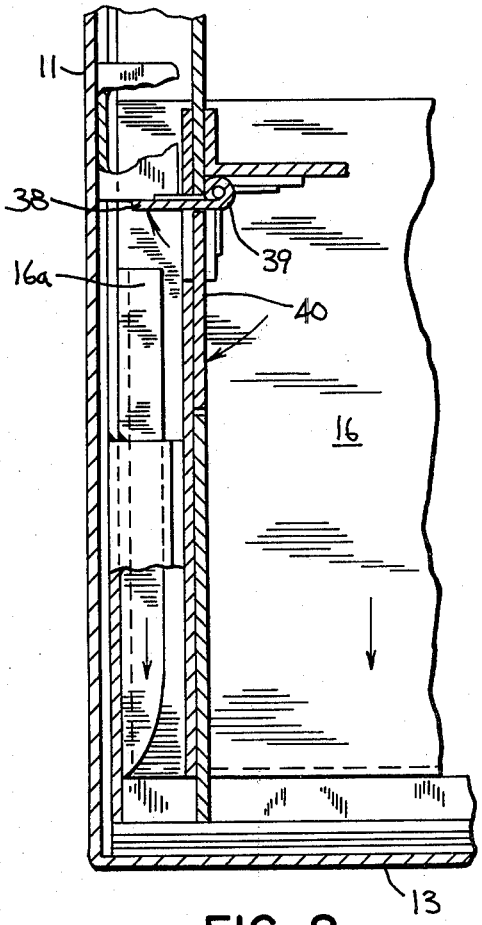

As seen in FIG. 4, when the lock and latch 18 is opened as with the key 19, the front piece 12 can be swung downwardly to open the housing 11. To facilitate the replacement of spent rolls of tissue each of the spindles 21 and 22 is mounted on its own movable arm 25 and 26, respectively, which is pivotally attached at a point 27 to a support 28 (as seen best in FIGS. 3 and 4). The support 28 is attached to the shelf 20 of the front piece 12. When the housing 11 is closed as seen in FIG. 3, with the door 16 closing compartment A, the roll 23 mounted on spindle 21 on arm 25 is within compartment A behind the door 16 and roll 24 on spindle 22 on arm 26 is in compartment B in dispensing position. As seen best in FIG. 2, when the housing 11 is thus closed a stabilizer 29 which is attached to the inside of the front piece 12 and which has a pair of spindle receiving grooves 30 and 31 for receiving the free ends 21*a* and 22*a* of the spindles 21 and 22, respectively, helps maintain the spindles and their respective rolls in the proper position.

Referring back to FIG. 4, it can be seen that when the housing 11 is opened by swinging the front piece 12 down, the arms 25 and 26 bearing the spindles 21 and 22 can be individually rotated outwardly from the position shown in solid lines to the position shown in broken lines to allow spent rolls of tissue to be replaced with new rolls. Once the spindles 21 and 22 have been loaded with the tissue rolls, the arms 25 and 26 are rotated inwardly back to the positions shown in solid lines in FIG. 4 and the front piece 12 swung upwardly to close the housing 11 as seen in FIG. 3. When the housing 11 is closed, the front piece 12 is secured in place by the cooperation of the lock and latch 18 and a catch 32 inside the housing 11, as best seen in FIGS. 2 and 3.

Returning to FIGS. 2 and 3, it can be seen that when the spindles 21 and 22 are loaded with the tissue rolls 23 and 24 and the housing 11 is closed, the free ends 21*a* and 22*a* of the spindles 21 and 22 are retained in the grooves 30 and 31, respectively, by a second stabilizer 33 which is attached to and extends inwardly from the back wall 11*a* of the housing 11. When the dispenser 10 is loaded, the door 16 is raised and the housing 11 is closed, the primary tissue roll 24 is available for dispensing and the upper reserve tissue roll 23 is behind the door 16. When the door 16 is lowered to open compartment A, the movable arm 25 with its spindle 21 bearing the tissue roll 23 is urged forward into dispensing position by a spring roll retainer 34 attached to the rear of the housing 11 (seen best in FIG. 3) and a second spring roll retainer 35 attached to the inside of a sidewall of housing 11 (seen only in FIG. 2). The spring roll retainer 34 presses against a step 25*a* on the arm 25 to force the arm 25 outwardly and the spring roll retainer 35 pushes against the spindle 21 also helping to move the roll 23 into dispensing position.

The movement of the door 16, which prevents the reserve tissue roll 23 from being used before the primary tissue roll 24 is exhausted is controlled by a door control mechanism 36 which is best seen in FIGS. 5, 6, 7 and 8. As seen therein, the door 16 slides in a pair of channels 37 and 37' and the door control mechanism 36 includes a pawl 38 (best seen in FIG. 6) which extends into and removably blocks the channel 37 in which one edge 16*a* of the door 16 slides. The pawl 38 is held in place blocking the channel 37 by a reverse spring hinge 39 attached to the shelf 20 (best seen in FIG. 2). The door 16 is moved to expose the reserve roll in compartment A and close compartment B by forcibly pressing down on the handle 17 to overcome the upward bias of the reverse spring 39 and to cause the edge 16*a* of the door which is tapered to move the pawl 38 downwardly and inwardly out of the channel 37. The foregoing only can happen if the primary tissue roll 24 in compartment B is exhausted. The door 16 cannot be moved downwardly before the primary roll 24 is exhausted because the pawl 38 is rigidly connected to a sensor 40 which cannot move until the tissue on roll 24 is exhausted. The sensor 40 extends downwardly along the side of the tissue roll 24, and it is of sufficient length so that as long as the roll 24 has a usable amount of tissue thereupon, the increased diameter of the roll 24 prevents the sensor 40 from moving inwardly and the pawl 38 from being moved out of the channel 37. However, when the tissue on the roll 24 is sufficiently exhausted, the free end of the sensor 40 can move inwardly and the door 16 can be lowered to expose the reserve tissue roll 23 in compartment A for use.

When the door 16 is fully lowered to expose compartment A, the reserve roll 23 which is mounted on the spindle 21 on arm 25 is urged forward to a dispensing position by the spring roll retainers 34 and 35 as previously described. At the same time, the reverse spring 39 returns the pawl 38 to its original position in channel 37 which prevents the door 16 from being raised to expose compartment B until the front piece 12 is unlocked and opened. When the housing 11 is opened for loading by unlocking and swinging outwardly the hinged front piece 12, the pawl 38 is moved out of channel 37 by simply raising the door 16 to its original position whereupon the pawl 38 is caused by the reverse spring 39 to assume its original position preventing the door 16 from falling until forcibly lowered.

In contrast to many of the prior art devices, the tissue dispenser of the present invention presents only the primary roll for dispensing and protects the second or reserve roll from premature use or vandalism. Premature access to the reserve roll is effectively precluded by the shelf 20 between the compartments A and B and the door 16 and door control mechanism 36. However, access to the reserve roll may be readily obtained when the primary roll is exhausted by the user following the simple instruction, preferably printed on the door or the handle of the door, to move the door down. The dispenser of the present invention is also unique in its use of a door control mechanism with a reverse spring. The door control mechanism with its reverse spring not only prevents premature access to the reserve roll but it also permits the person serving the dispenser to return the half door to its initial position when the front piece is unlocked and opened without the need for additional manipulation.

It will be readily apparent to those skilled in the art that a number of modifications and changes can be made without departing from the spirit and scope of the present invention. Therefore, it is intended that the invention not be limited except by the claims which follow.

We claim:

1. An improved two roll tissue dispenser including a hollow housing having a pair of compartments each having means for holding a roll of tissue, a hinged front piece for said housing, said front piece having a door opening, a sliding half door mounted in said opening, said door being movable from an original position closing one compartment to a second position closing the other compartment, and door control means for preventing the door from being moved from its original position until the roll of tissue in the other compartment is exhausted, wherein the improvement comprises a shelf attached to the inside of the front piece, a support attached to said shelf and a pair of movable arms each having a spindle for a roll of tissue at one end, each of said arms being pivotally attached at its other end to said support.

2. The dispenser of claim 1 which includes a door control means which consists of a movable pawl which in its initial position prevents the door from being moved and a sensor which stops the pawl from being moved from its initial position until substantially all of the tissue on a tissue roll on the spindle in the other compartment has been exhausted.

3. The dispenser of claim 2 in which the door control includes a reversible spring which holds the movable pawl in its initial position until the door is forcibly lowered when substantially all the tissue on the tissue roll on the spindle in the other compartment is exhausted, said spring also preventing the door from being returned to its original position until the hinged front piece is swung open whereupon the door can be raised.

4. An improved roll tissue dispenser including a hollow housing having a pair of compartments each having means for holding a roll of tissue, a hinged front piece for said housing, said front piece having a door opening, a sliding half door mounted in said opening, said door being movable from an original position closing one compartment to a second position closing the other compartment, and door control means for preventing the door from being moved from its original position until the roll of tissue in the other compartment is exhausted, wherein the improvement comprises a door control means which consists of a movable pawl which in its initial position prevents the door from being moved, a sensor which stops the pawl from being moved from its initial position until substantially all of the tissue on a tissue roll on the spindle in the other compartment has been exhausted, and a reversible spring which holds the movable pawl in its initial position until the door is forcibly lowered when substantially all the tissue on the tissue roll on the spindle in the other compartment is exhausted, said spring also preventing the door once lowered from being returned to its initial position until the hinged front piece is swung open whereupon the door can be raised.

* * * * *